United States Patent [19]

Paden

[11] 4,190,062

[45] Feb. 26, 1980

[54] SMOKING DEVICE

[76] Inventor: Jack R. Paden, P.O. Box 80211, Lincoln, Nebr. 68501

[21] Appl. No.: 19,503

[22] Filed: Mar. 12, 1979

Related U.S. Application Data

[63] Continuation-in-part of Ser. No. 837,899, Sep. 29, 1977, abandoned.

[51] Int. Cl.[2] ..... A24F 1/26; A24F 3/00

[52] U.S. Cl. ..... 131/180; 131/185

[58] Field of Search ..... 131/180, 181, 178, 170 R, 131/185, 221, 226, 223

[56] References Cited

U.S. PATENT DOCUMENTS

| | | | |
|---|---|---|---|
| 1,053,039 | 2/1913 | Karnes | 131/180 |
| 2,595,534 | 5/1952 | Nicholson et al. | 131/185 |
| 2,647,522 | 8/1953 | Schneider | 131/178 |
| 3,698,400 | 10/1972 | Tucker | 131/185 |
| 4,044,781 | 8/1977 | Heggestuen | 131/223 X |
| 4,146,048 | 3/1979 | Maiorana | 131/185 |
| 4,151,849 | 5/1979 | Beck | 131/180 |

*Primary Examiner*—Stephen C. Pellegrino

*Attorney, Agent, or Firm*—Zarley, McKee, Thomte, Voorhees & Sease

[57] ABSTRACT

A smoking device comprises a housing having a cavity for the storage of smoking substance, a flame generator and a bowl body rotatably supported in the housing in communication with the cavity. The bowl body has a smoking chamber therein, a first opening for receiving and discharging smoking substance and a small second opening through which smoke may be drawn. The housing has several openings in communication with the bowl body including a discharge opening, a flame and air intake opening adjacent the flame generator, and a smoke passage through which smoke is drawn. The bowl body is rotatable between a loading position wherein the first opening is registered with the cavity for receiving smoking substance therefrom, a smoking position wherein the first opening is registered with the flame and air intake opening and the second opening is registered with the smoke passage whereby flame from the flame generator may be drawn into the smoking chamber to incinerate the smoking substance in response to air being drawn through the smoke passage. In the discharge position of the bowl body, the first opening is registered with the housing discharge opening.

24 Claims, 15 Drawing Figures

SMOKING DEVICE

CROSS REFERENCE TO RELATED APPLICATION

This application is a continuation-in-part of my application Ser. No. 837,899, filed Sept. 29, 1977 now abandoned.

BACKGROUND OF THE INVENTION

This invention relates generally to a smoking device and more particularly concerns an integral compact pipe including a smoking substance storage cavity, a flame generator and a smoking chamber movably supported for loading, smoking and discharging smoking substance therefrom.

Problems associated with the conventional smoker's pipe are that the smoking substance must be carried in a separate pouch, and a match or lighter device and cleaning tools must be carried in addition to the pipe. It is therefore cumbersome to carry all of the paraphernalia required for smoking a conventional pipe. Pipes have been devised with built-in lighters but the smoker's pouch and cleaning tools were still required for these pipes. Water pipes have been provided with a hopper for dispensing smoking substance into a bowl cavity movable into registration with an air opening for smoking the substance in the cavity but these are generally elongated cumbersome structures which must be maintained in an upright disposition and are not easily transported on one's person.

These problems are resolved by the smoking device of the present invention.

SUMMARY OF THE INVENTION

Accordingly, it is a primary object of the present invention to provide an improved smoking device.

Another object of the invention is to provide a smoking device which, in one integral housing, includes a smoking substance storage cavity, a flame generator and a smoking chamber movable between positions for loading, smoking and discharging smoking substance therein.

A further object of the invention is to provide a smoking device having a rotatable cylindrical bowl body.

A related object of the invention is to provide a smoking device wherein the bowl body is rotatable between loading, smoking and discharge positions.

A further related object of the invention is to provide a smoking device including stop means for limiting rotation of the bowl body to selected positions therefor.

Finally, it is an object of the invention to provide a smoking device which is compact in construction, durable in use, refined in appearance and efficient in operation.

The smoking device of the present invention therefore provides a compact housing embodying a smoking system capable of storing the smoking substance, filling a smoking chamber with the substance and relocating the smoking chamber to an aligned position for ignition by momentary exposure to a flame generated within the housing. Smoke is drawn through a port on the housing and, after completion of incineration, the smoking chamber can be repositioned into alignment with a discharge port for discharging from the housing the ashes generated during incineration. The smoking device of the invention is thus wholly self-contained. It may be easily carried in one's pocket with no concern for the orientation of the device as it is carried.

DESCRIPTION OF THE PREFERRED EMBODIMENTS

Figure 1:
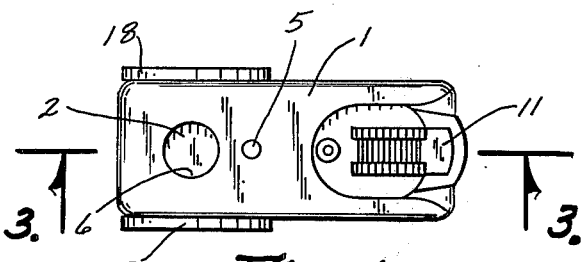
FIG. 1 is a top view of the smoking device of the invention.
Figure 2:
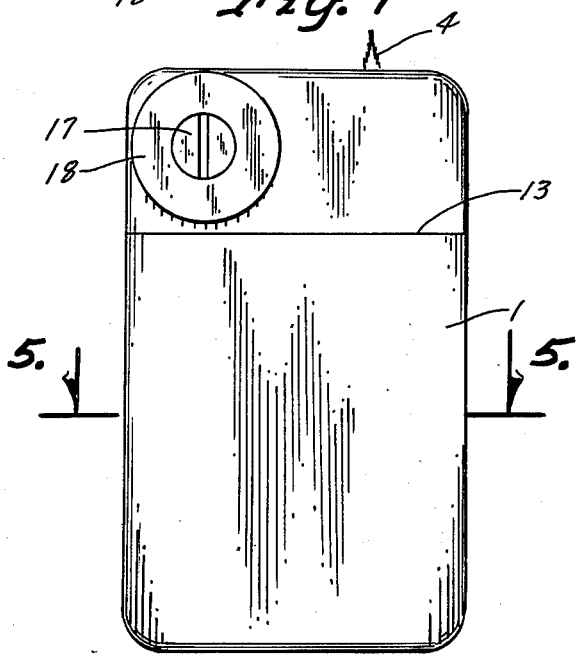
FIG. 2 is a front elevational view of the smoking device.
Figure 4:
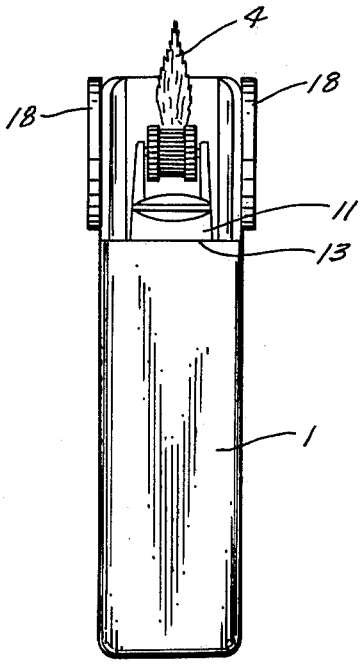
FIG. 4 is a side view of the smoking device.

Referring to FIG. 1, a housing 1 encloses a cavity 3 to store a smoking substance. Another cavity holds a mechanism 11, of any suitable nature such as a common cigarette lighter, capable of generating a flame on command by the operator.

Housing 1 is also provided with appropriate passages or ports which communicate with a cylindrical bowl body 12 to provide a choice of functional positions therefor. When the bowl body 12 is positioned such that a smoking chamber 2 therein is aligned with a port 8, and the entire device is held in an upside down position, the smoking substance by gravity is forced into the smoking chamber 2. By rotating the cylindrical bowl body 12 to align the filled smoking chamber 2 with a port 5 (this is the position shown in FIG. 3), the considered bottom of the smoking chamber is also in alignment with a port 7, thereby creating an airflow path from port 5 and through a smoke passage 9 to the operator. The operator can then actuate a flame source 11 to generate a flame at the location designated 4. When airflow through the above-described path is taking place simultaneously with the flame being actuated, the flame is drawn into port 5 thereby igniting the smoking substance. After the operater has completed this operation, the bowl body 12 is then positioned to align the smoking chamber 2 with a port 6. In this position, the ash is expelled from the smoking chamber 2 through port 6.

Figure 3:
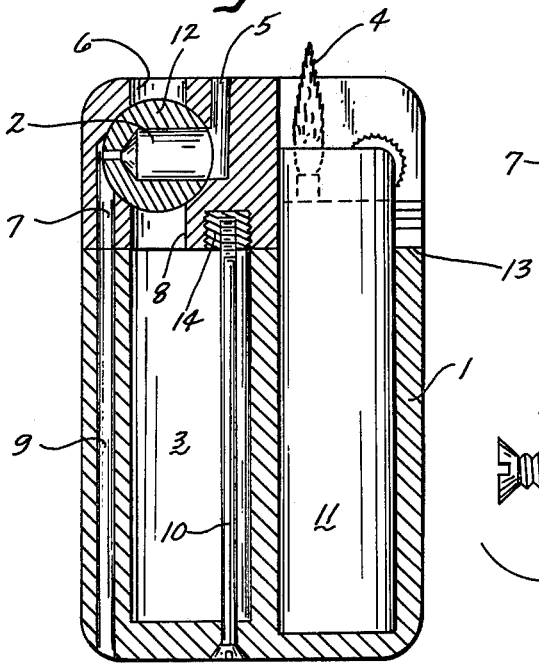
FIG. 3 is a front sectional view, taken along line 3—3 in FIG. 1.
Figure 5:
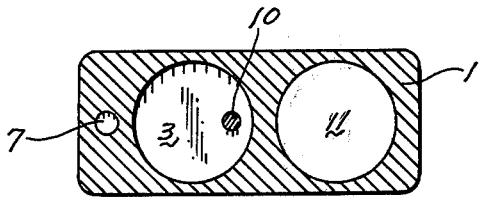
FIG. 5 is a top sectional view, taken along line 5—5 in FIG. 2.

Referring to FIG. 3 and 5, a screw 10 maintains the two major portions of the housing against each other at the separation plane 13. This separation is to allow storage cavity 3 to be filled with the smoking substance. A brass insert 14 may be threaded into the top portion of the housing for threadably receiving screw 10.

Figure 6:
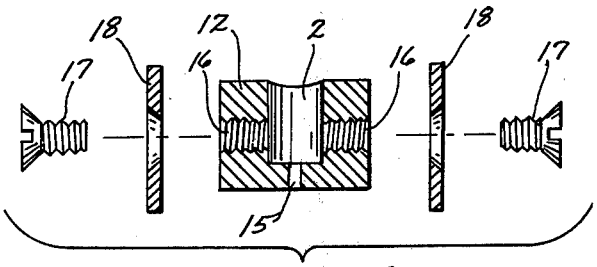
FIG. 6 is an exploded detail view of the bowl body of the device.
Figure 7:
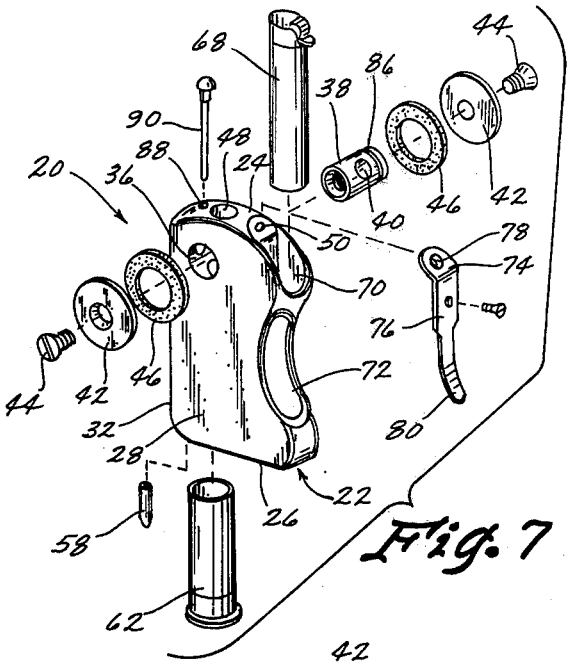
FIG. 7 is an exploded perspective view of an alternate embodiment of the invention.
Figure 8:
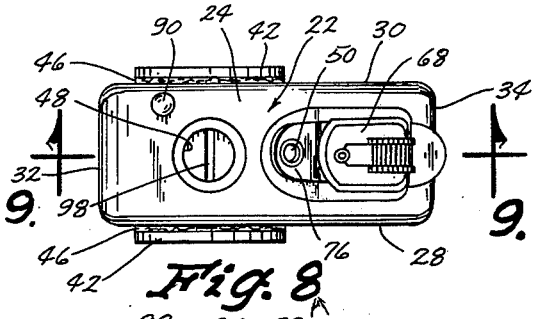
FIG. 8 is an enlarged top view of the device of FIG. 7.

In FIG. 6, bowl body 12 is shown as a cylindrical member having a radial bore for a smoking chamber 2, an aligned bore 15 through which smoke may be drawn, and a pair of axially directed tapped holes 16 for threadably receiving fastening screws 17. A pair of brass discs 18 are secured against opposite ends of bowl body 12 by screws 17 for axially retaining the bowl body 12 within the housing.

An alternate embodiment 20 of the smoking device of the invention is shown in FIG. 7–14. An integral one piece housing 22 has an arcuate top wall 24, a bottom wall 26, front and back walls 28 and 30 and opposite sidewalls 32 and 34. A transverse bore 36 is formed through an upper portion of the housing for rotatably receiving a cylindrical bowl body 38 having a smoking chamber 40 formed therein. A pair of discs 42 and screws 44 axially secure bowl body 38 within the housing 22 just as in the previous embodiment except that a pair of seal rings 46 are interposed between the discs 42 and housing walls 28 and 30.

Figure 9:
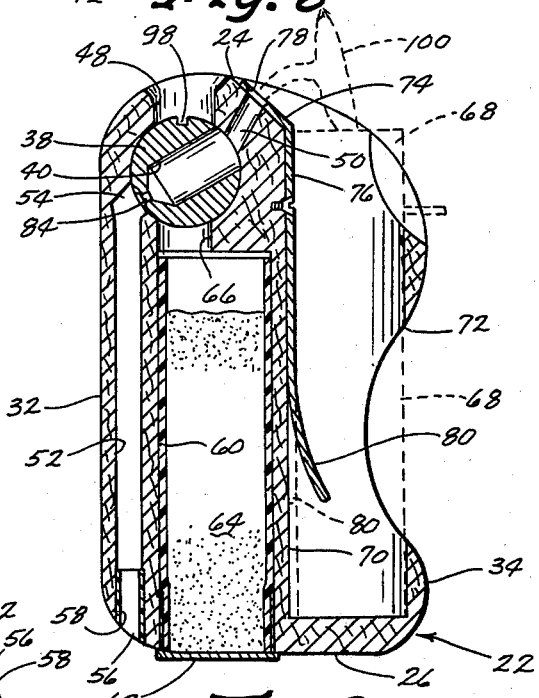
FIG. 9 is a front sectional view of the device, as seen on line 9—9 in FIG. 8.
Figure 10:
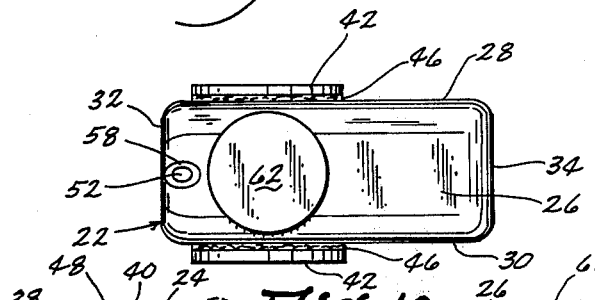
FIG. 10 is a bottom view of the device of FIG. 7.

Referring to FIG. 9, the housing has a plurality of passages communicating with the bowl body including a discharge opening 48 and a flame and air intake opening 50, both of which open through top wall 24. In addition, an elongated smoke passage 52 has an inner end 54 in communication with bowl body 38 and an open outer end 56 through which smoke may be drawn into an operator's mouth. A plastic tubular insert 58 may be fitted within outer end 56. Finally, the housing is provided with a large generally central cylindrical cavity 60 for the storage of smoking substance. An open ended cartridge 62 containing smoking substance 64 is axially receivable into cavity 60 and frictionally retained therein with its open end in communication with the bowl body 38 through a bore 66.

A flame for lighting the smoking substance is provided by a flame generating means 68, shown as a conventional butane lighter. Lighter 68 is slidably received into an open topped pocket 70. Since housing sidewall 34 is concave, an opening 72 is provided through which the lighter 68 may be contacted for sliding the lighter in and out of pocket 70. At the top of pocket 70, an upwardly and inwardly inclined wall portion 74 has intake opening 50 formed therein so that flame from the lighter 68 may be drawn through intake opening 50. A fire plate 76 overlies wall portion 74 and has an opening 78 registered with intake opening 50 and a lower spring clip portion 80 extended into pocket 70 for retaining lighter 68 therein.

Figure 11:
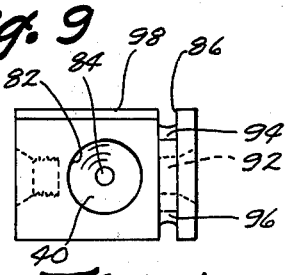
FIG. 11 is an enlarged detail view of the bowl body.

Bowl body 38, as shown in FIGS. 9 and 11, has a relatively large first opening 82 for the insertion and removal of smoking substance from the smoking chamber 40 and a diametrically aligned second opening 84 at the opposite end of the smoking chamber. Second opening 84 is both internally and externally countersunk to prevent a buildup of combustion products in the opening. In FIG. 11 there is shown a circumferential channel 86 formed in the periphery of the bowl body and axially positioned for registration with a small bore 88 through housing top wall 24 adapted for retaining a poker pin 90 therein. Pin 90 is thus disposed within channel 86 tangentially of the bowl body 38. Pin 90 has a diameter substantially equal to that of the second opening 84 for cleaning the same. A filler material 92 is secured within channel 86 to present opposite first and second stop surfaces 94 and 96. An axially extended notch 98 is also cut in the periphery of bowl body 38. The purpose of the stop surfaces and notch are described below.

Figure 12:
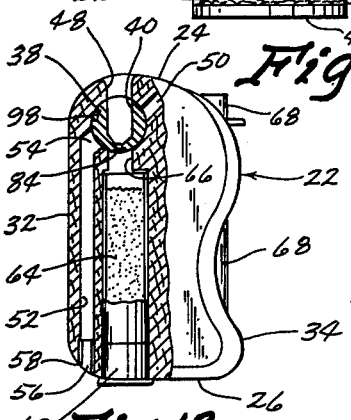
FIG. 12 is a diagrammatic sectional view of the device.
Figure 13:
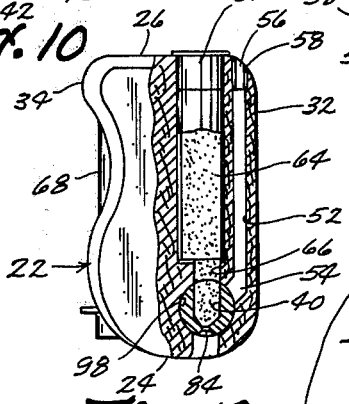
FIG. 13 is a diagrammatic partly sectional view of the device showing the unloading position for the smoking chamber.
Figure 14:
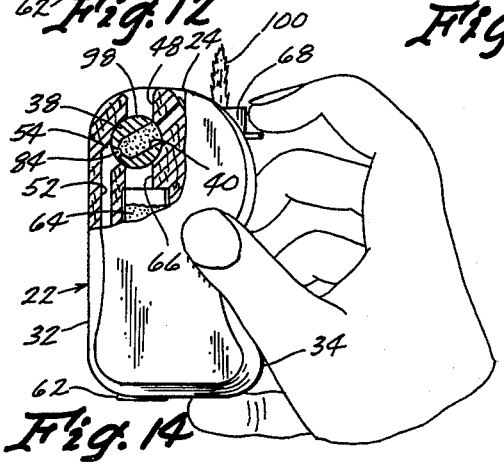
FIG. 14 is a diagrammatic partly sectional view of the device with the smoking chamber in the smoking position therefor.
Figure 15:
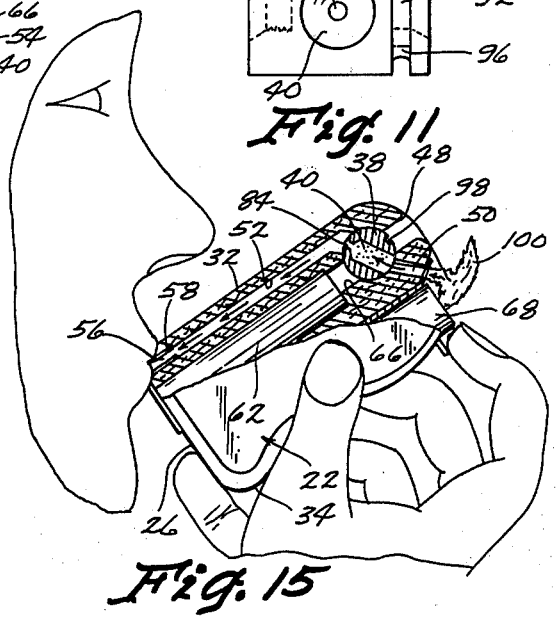
FIG. 15 is a diagrammatic, partly sectional view of the device in use.

In operation, an operator need only rotate the bowl body 38 so that the smoking chamber 40 is arranged in upright relation as shown in FIG. 12 and then rotate the housing about the bowl body to the position of FIG. 13 wherein smoking substance falls by gravity through bore 66 and first opening 82 into the smoking chamber. This is the loading position for the bowl body with first opening 82 registered with cavity 60. The housing is then rotated back to the position of FIG. 12 and bowl body 38 is rotated to the smoking position therefor wherein the first opening 82 is registered with intake opening 50 and second opening 84 is registered with smoke passage 52 as shown in FIG. 14. Although first opening 82 is not visible to the operator, the bowl body may be correctly positioned by centering notch 98 within the discharge opening 48. The operator then uses his forefinger to strike lighter 68 and generate a flame 100. The operator then places mouthpiece 58 to his lips and inhales to draw the flame 100 through intake opening 50 and into the smoking chamber 40 to incinerate the smoking substance therein. The flame should be on no longer than necessary and, once extinguished, the operator's forefinger may be placed over the discharge opening 48 to regulate the draw. When incineration is complete, bowl body 38 is rotated to the discharge position therefor wherein first opening 82 is registered with discharge opening 48 as shown in FIG. 12 for removal of the ashes from the housing. The stops 94 and 96 in the bowl body channel 86 engage poker pin 90 when the bowl body is in approximately the discharge and loading positions therefor respectively.

Thus there has been shown a smoking device which is wholly self-contained, of compact size and easily carried on one's person for convenient use whenever it is desired to smoke.

Whereas preferred embodiments of the invention have been described herein, it is readily apparent that many alternatives, modifications and variations may be made which fall within the scope of the appended claims.

I claim:

1. A smoking device comprising, a housing, said housing having a cavity for the storage of a smoking substance therein, flame generating means in said housing, and a bowl body rotatably supported in said housing and having a smoking chamber therein, said bowl body having a first opening for the insertion and removal of smoking substance from said smoking chamber and a second opening small enough to substantially block the passage of smoking substance therethrough, said housing having a smoking substance discharge opening in communication with said bowl body, a flame and air intake opening in communication with said bowl body and situated adjacent said flame generating means, and an elongated smoke passage in communication with the bowl body at one end and open at the other end for drawing smoke therethrough, said bowl body being rotatable between a loading position wherein said first opening is registered with said cavity for receiving smoking substance therefrom, a smoking position wherein said first opening is registered with said flame and air intake opening and said second opening is registered with said smoke passage whereby flame from said flame generating means may be drawn into the smoking chamber to incinerate the smoking substance in response to air being drawn through the smoke passage, and a discharge position wherein said first opening is registered with said discharge opening for removing smoking substance from said chamber and housing.

2. The smoking device of claim 1 wherein said first and second openings in the bowl body are arranged in diametrically opposed relation.

3. The smoking device of claim 1 wherein said second opening is internally and externally countersunk.

4. The smoking device of claim 1 further comprising an open ended smoking substance cartridge adapted to be removably inserted into said cavity with the open end thereof in communication with said bowl body.

5. The smoking device of claim 1 wherein said flame generating means comprises an elongated lighter body adapted to generate a flame at one end thereof.

6. The smoking device of claim 5 wherein said smoke passage, cavity and lighter body are arranged in closely spaced side-by-side relation.

7. The smoking device of claim 5 wherein said flame generating means comprises a butane lighter.

8. The smoking device of claim 5 wherein said housing includes an elongated socket adapted to axially receive said elongated lighter body, said housing having a side opening in communication with said socket through which said lighter body may be contacted for axially moving said lighter body.

9. The smoking device of claim 1 wherein said bowl body is generally tubular.

10. The smoking device of claim 9 further comprising means for axially securing said bowl body within said housing.

11. The smoking device of claim 10 wherein said means for axially securing said bowl body comprise a pair of discs of greater diameter than said tubular bowl body, means for securing said discs to the opposite ends of said bowl body, said discs adapted to operatively engage opposite sides of said housing.

12. The smoking device of claim 11 further comprising annular seals interposed between said discs and housing.

13. The smoking device of claim 9 wherein said bowl body has a circumferential channel formed in the periphery thereof, said channel including stop means, and means on said housing insertable into said channel and engageable with said stop means when said bowl body is rotated to a limit position therefor.

14. The smoking device of claim 13 wherein said means on said housing insertable into said channel comprises an elongated poker pin having a diameter substantially equal to said second opening for cleaning the same, said housing having a bore through which said poker pin may be inserted into said channel tangentially of said bowl body.

15. The smoking device of claim 13 wherein said channel includes first and second stop means, said means on said housing being engageable with said first stop means when said bowl body is approximately in the loading position therefor and engageable with said second stop means when said bowl body is approximately in the discharge position therefor.

16. The smoking device of claim 1 further comprising a fire plate positioned on said housing around said flame and air intake opening, said fire plate having an opening in registration with said flame and air intake opening.

17. The smoking device of claim 1 further comprising indicia means on said bowl body, said indicia means being positioned to be visible through said discharge opening when said bowl body is in the smoking position therefor.

18. The smoking device of claim 17 wherein said indicia means comprises a notch formed in said bowl body.

19. The smoking device of claim 1 wherein said housing includes a top wall, bottom wall, front and back walls and opposite sidewalls, said discharge opening and intake opening being located at the top wall and said cavity and smoke passage opening through said bottom wall.

20. The smoking device of claim 1 wherein said cavity is situated between said flame generating means and smoke passage.

21. The smoking device of claim 20 wherein said intake opening communicates with said bowl body at a location higher than the location of communication between the bowl body and smoke passage whereby a generally linear flow path is formed through said intake opening, smoking chamber and upper end of the smoke passage.

22. A smoking device comprising, a housing, said housing having a cavity for the storage of a smoking substance therein, a bowl body rotatably supported in said housing and having a smoking chamber therein, said bowl body having a first opening for the insertion and removal of smoking substance from said smoking chamber and a second relatively smaller opening through which smoke may be drawn from said chamber, said housing having a smoke passage in communication with the bowl body at one end and open at the other end for drawing smoke therethrough and an intake opening positioned for registration with said first opening when said second opening is registered with said smoke passage, a flame generating means in said housing adapted to generate a flame at a position adjacent said intake opening, said bowl body being rotatable between a loading position wherein said first opening is registered with said cavity for receiving smoking substance therefrom, and a smoking position wherein said first opening is registered with said intake opening and said second opening is registered with said smoke passage whereby flame from said flame generating means may be drawn into the smoking chamber through said intake opening to incinerate the smoking substance in said smoking chamber in response to air being drawn through the smoke passage.

23. A smoking device comprising, a housing, said housing having a cavity for the storge of a smoking substance therein, flame generating means in said housing, and a bowl body movably supported in said housing and having a smoking chamber therein, said bowl body having a first opening for the insertion and removal of smoking substance from said smoking chamber and a second opening small enough to substantially block the passage of smoking substance therethrough, said housing having a smoking substance discharge opening in communication with said bowl body, a flame and air intake opening in communication with said bowl body and situated adjacent said flame generating means, and an elongated smoke passage in communication with the bowl body at one end and open at the other end for drawing smoke therethrough, said bowl body being movable between a loading position wherein said first opening is registered with said cavity for receiving smoking substance therefrom, a smoking position wherein said first opening is registered with said flame and air intake opening and said second opening is registered with said smoke passage whereby flame from said flame generating means may be drawn into the smoking chamber to incinerate the smoking substance in response to air being drawn through the smoke passage, and a discharge position wherein said first opening is registered with said discharge opening for removing smoking substance from said chamber and housing.

24. A smoking device adapted for use with a flame generating means, comprising, a housing, said housing having a cavity for the storage of a smoking substance therein, and a bowl body rotatably supported in said housing and having a smoking chamber therein, said bowl body having a first opening for the insertion and removal of smoking substance from said smoking chamber and a second opening small enough to substantially block the passage of smoking substance therethrough, said housing having a smoking substance discharge opening in communication with said bowl body, and an elongated smoke passage in communication with the bowl body at one end and open at the other end for drawing smoke therethrough, said housing including means for supporting a flame generating means adjacent said bowl body, said bowl body being rotatable between a loading position wherein said first opening is registered with said cavity for receiving smoking substance therefrom, a smoking position wherein said first opening is rotated out of registration with said cavity and communication is established between said smoking chamber and said flame generating means and said second opening is registered with said smoke passage whereby flame from said flame generating means may be drawn into the smoking chamber to incinerate the smoking substance in response to air being drawn through the smoke passage, and a discharge position wherein said first opening is registered with said discharge opening for removing smoking substance from said smoking chamber and housing.

* * * * *